US007532117B2

(12) United States Patent
Barrieau et al.

(10) Patent No.: US 7,532,117 B2
(45) **Date of Patent: *May 12, 2009**

(54) FIRE ALARM WITH DISTINCT ALARM RESET THRESHOLD

(75) Inventors: Mark P. Barrieau, Baldwinville, MA (US); Robert W. Farley, Ashburnham, MA (US)

(73) Assignee: SimplexGrinnell LP, Westminster, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/500,851

(22) Filed: Aug. 8, 2006

(65) Prior Publication Data

US 2007/0008158 A1 Jan. 11, 2007

Related U.S. Application Data

(63) Continuation of application No. 10/705,146, filed on Nov. 10, 2003, now Pat. No. 7,091,855.

(60) Provisional application No. 60/502,335, filed on Sep. 12, 2003.

(51) Int. Cl.
*G08B 21/00* (2006.01)

(52) U.S. Cl. ..... 340/540; 340/584; 340/628; 340/691.6; 340/692

(58) Field of Classification Search ..... 340/584, 340/577, 628, 691.1, 691.4–691.6, 692, 511, 340/540, 870.16, 870.17
See application file for complete search history.

(56) References Cited

U.S. PATENT DOCUMENTS

| | | | |
|---|---|---|---|
| 3,623,087 | A | 11/1971 | Gallichotte et al. |
| 4,864,283 | A | 9/1989 | Seto |
| 5,151,683 | A | 9/1992 | Takahashi et al. |
| 5,262,758 | A | 11/1993 | Nam et al. |
| 5,663,714 | A | 9/1997 | Fray |
| 5,936,532 | A | 8/1999 | Peralta |
| 6,239,697 | B1 | 5/2001 | Murao |
| 6,753,786 | B1 | 6/2004 | Apperson et al. |
| 6,791,453 | B1 | 9/2004 | Andres et al. |
| 6,847,300 | B2 | 1/2005 | Yee et al. |
| 2002/0080039 | A1 | 6/2002 | Vining |

FOREIGN PATENT DOCUMENTS

| | | | |
|---|---|---|---|
| EP | 0 011 205 | A1 | 5/1980 |
| EP | 0 011 205 | B1 | 8/1982 |
| EP | 0 381 017 | B1 | 8/1995 |
| WO | WO 02/15137 | A2 | 2/2002 |
| WO | WO 02/15415 | A2 | 2/2002 |

*Primary Examiner*—Thomas J Mullen
(74) *Attorney, Agent, or Firm*—Grossman Tucker Perreault & Pfleger

(57) ABSTRACT

A hazard alarm includes: a detector for detecting a hazard parameter, trigger logic; and reset logic. The trigger logic triggers an alarm state when the measured parameter reaches a predetermined trigger threshold. The alarm state is maintained until a reset is successfully performed. The reset logic, upon a reset command, resets the alarm state if the measured parameter is below a predetermined reset threshold, and inhibits resetting of the alarm state if the measured parameter is above the predetermined reset threshold.

32 Claims, 8 Drawing Sheets

FIRE ALARM WITH DISTINCT ALARM RESET THRESHOLD

RELATED APPLICATION

This application is a continuation of U.S. application Ser. No. 10/705,146, filed Nov. 10, 2003, now U.S. Pat. No. 7,091, 855, which claims the benefit of U.S. Provisional Application No. 60/502,335, filed Sep. 12, 2003.

The entire teachings of the above applications are incorporated herein by reference.

BACKGROUND OF THE INVENTION

Conventional fire and smoke detection methods and apparatus generally include the use of well-known smoke and heat detectors, such as ionization smoke detectors and photooptical smoke detectors. These devices can be used as independent detector systems, such as those typically found in home use, or as peripheral devices reporting alarm conditions to a centralized system as is commonly used in larger buildings and in industrial use.

Whether these devices are used as stand-alone systems or peripheral devices, the principle of their operation is generally the same. For example, a light-scattering type photooptical detector generally comprises a light-emitting source, such as a light-emitting diode (LED), and a light sensor, such as a photo diode, contained in a substantially light proof sample chamber having low reflectance walls. Light from the light-emitting source is reflected off the low reflectance walls to the light sensor, which is out of the direct path of light. Air surrounding the photooptical detector passes generally freely in and out of the sample chamber. When ambient air is relatively free from fire or combustion products, such as smoke, only a relatively small amount of light from the LED is reflected off the chamber walls to be detected by the light sensor. This low light receiving condition is the normal or no-alarm state in the photooptical detector.

As the amount of combustion products increases, the amount of light reflected or scattered by the combustion products increases. The increased light scattering generally increases the amount of light reaching the light sensor proportionally. This phenomenon generally correlates to percent obscuration per foot. Simply put, percent obscuration per foot is a measurement of the reduction in visibility the human eye would see in a room containing combustion products.

FIG. 1 is a graph 10 illustrating the typical operation of an existing alarm. The amount of light detected by the light sensor may be represented as a voltage output, for example in the range of 0 volts and 5 volts. The curve 12 represents the detector voltage output as it varies in time due to circumstances presented for exemplary purposes. As the amount of light detected by the light detector increases due to increased combustion products, the voltage output generally increases. Conventional ionization detectors also output increasing voltage as the smoke condition rises. When, at 16, the detector voltage output reaches a predetermined alarm threshold 14, an alarm condition is indicated by audible, visual or other indications for appropriate investigation or evacuation of the alarm area.

Many home alarm detectors automatically reset at 18 when the measured parameter (the detector voltage output) again falls below the alarm threshold 14. A small amount of hysteresis (not shown) may be provided to prevent the alarm from needlessly and annoyingly transitioning back and forth between alarm and non-alarm states when the measured parameter hovers for a time at or near the alarm threshold 14.

In another typical fire alarm operation, the alarm does not automatically reset itself, and emergency personnel must reset the fire alarm system after investigating the source of an alarm, for example, at 20. For an alarm reset to take place, the heat and/or smoke sensor(s) must be at a reading (temperature or "% smoke obscuration") lower than the alarm threshold 14.

For example, a 135° F. heat sensor will transition into an alarm state when the ambient temperature reaches 135° F. In the present art, a fire alarm system allows the system to reset to a normal (non-alarm) state as long as the measured parameter, at the time the reset key is pressed, is below the alarm threshold 14. The same holds true for smoke sensors, which are rated in "% obscuration per foot." As long as the sensor reading at reset is below the alarm threshold 14, a fire alarm control panel will perform a reset and indicate a normal condition.

SUMMARY OF THE INVENTION

An embodiment of the present invention can provide valuable insight to emergency responders by inhibiting an alarm reset unless a reading lower than a distinct alarm reset threshold has been obtained. Fire alarm personnel are notified that an unusual temperature or smoke level remains, and that perhaps further investigation is needed before declaring a sight "clear."

The alarm reset threshold, taken in the context of a site that has just experienced a fire alarm, is an indication that a smoldering fire may still exist, or that an unseen heat source is still present. Implementation of this feature can prevent "recalls" of fire department personnel after a flare up. Valuable time can be gained by informing these personnel that an abnormal state still exists.

For example, a 135° F. heat sensor might have an alarm reset threshold of 100° F. If, upon the instigation of a system reset, for example by pressing a reset button or otherwise initiating a reset request, the alarm threshold is below 135° F. but above 100° F., a warning message is displayed or, in the case of an audio warning, a message such as a prerecorded message is announced.

The alarm reset threshold may be set to a factory default, or it could be set to a level approved by a local authority. Alternatively, the alarm reset threshold may be automatically track the device's average analog value, i.e., its historic "normal" reading, with, for example, a 10% tolerance allowance.

A further embodiment provides means to allow override of the latched alarm based on a command from an Emergency Responder. This would allow departure of emergency personnel should they determine that no cause for concern exists.

The circuitry for implementing an alarm reset threshold, as well as the reset inhibition and override may be located on individual alarms, or on an alarm control panel, or both, according to the specific embodiment. Some embodiments may require the entry of a password before allowing an override.

In accordance with the present invention, a hazard alarm includes a detector (sensor) for measuring or detecting a hazard parameter, trigger logic and reset logic. The trigger logic triggers an alarm state when the measured parameter reaches a predetermined alarm threshold. The alarm state is maintained until a reset is successfully performed. The reset logic, upon a reset command, resets the alarm state if the measured parameter is below a predetermined reset threshold, and inhibits resetting of the alarm state if the measured parameter is above the predetermined reset threshold. "Logic" may be implemented, for example, using digital hardware (circuitry) and/or software, as well as analog circuitry. The hazard parameter may an indication of, but is not limited to: heat, fire, smoke, carbon monoxide, natural gas or other measurable dangerous conditions. The alarm may be, for example, an individual alarm unit, or an alarm control panel.

The inability to reset may be an indication that, for example, a smoldering fire still exists, or that an unseen heat source is present.

Preferably, the alarm threshold and reset threshold are sufficiently different to prevent reset of the alarm state when an abnormal condition continues to pertain even after the measured parameter falls below the alarm threshold.

An embodiment of the present invention may also include reset override logic which, when activated, overrides the reset inhibition by resetting the alarm state even if the measured parameter is not below the reset threshold.

A warning presenter, such as a display, may also be included which, upon a reset command, presents a warning message if the measured parameter is not below the reset threshold.

In one embodiment, the reset threshold is set to a factory default. Alternatively, the reset threshold may be set to a level approved by a local authority. Yet another possibility is for the reset threshold to be set to the alarm's average analog value.

Note that a measurement "upon reset" refers to a measurement taken at approximately the same time as the reset command. For example, such a measurement could be taken in response to the reset command; it could be the last previous measurement taken, or the next, or a combination of those, such as the result of the application of some formula (e.g. averaging) to several measurements.

In addition, references to exceeding the threshold include embodiments in which the threshold must be surpassed, and other embodiments where simply reaching the threshold is sufficient.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 2:
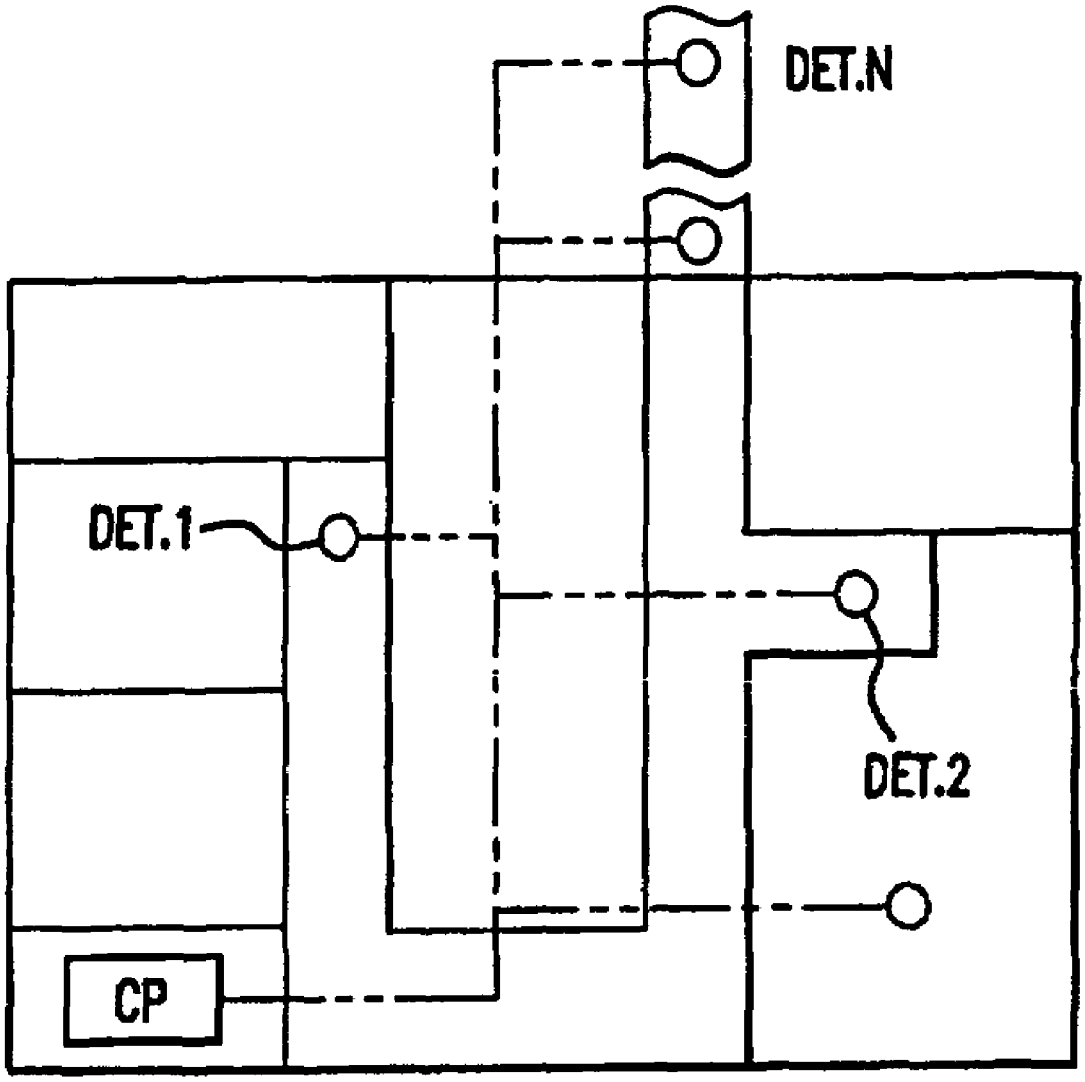
FIG. 2 is a schematic illustration of a building having peripheral detector devices interconnected with a central control panel in accordance with an embodiment of the present invention.

Referring to FIG. 2, the preferred alarm detection system according to the present invention comprises a plurality of peripheral sensors or detectors DET. 1, DET. 2 . . . DET. N which may be located at strategic positions in a building or other structure where fire or smoke detection is desired. These peripheral devices are connected via communication lines as illustrated in FIG. 2 for preferably centralized control and monitoring of the peripheral devices in a control panel CP. One such peripheral device/control panel communication system is disclosed in U.S. Pat. No. 4,796,025, the specification of which is incorporated herein by reference.

Figure 3:
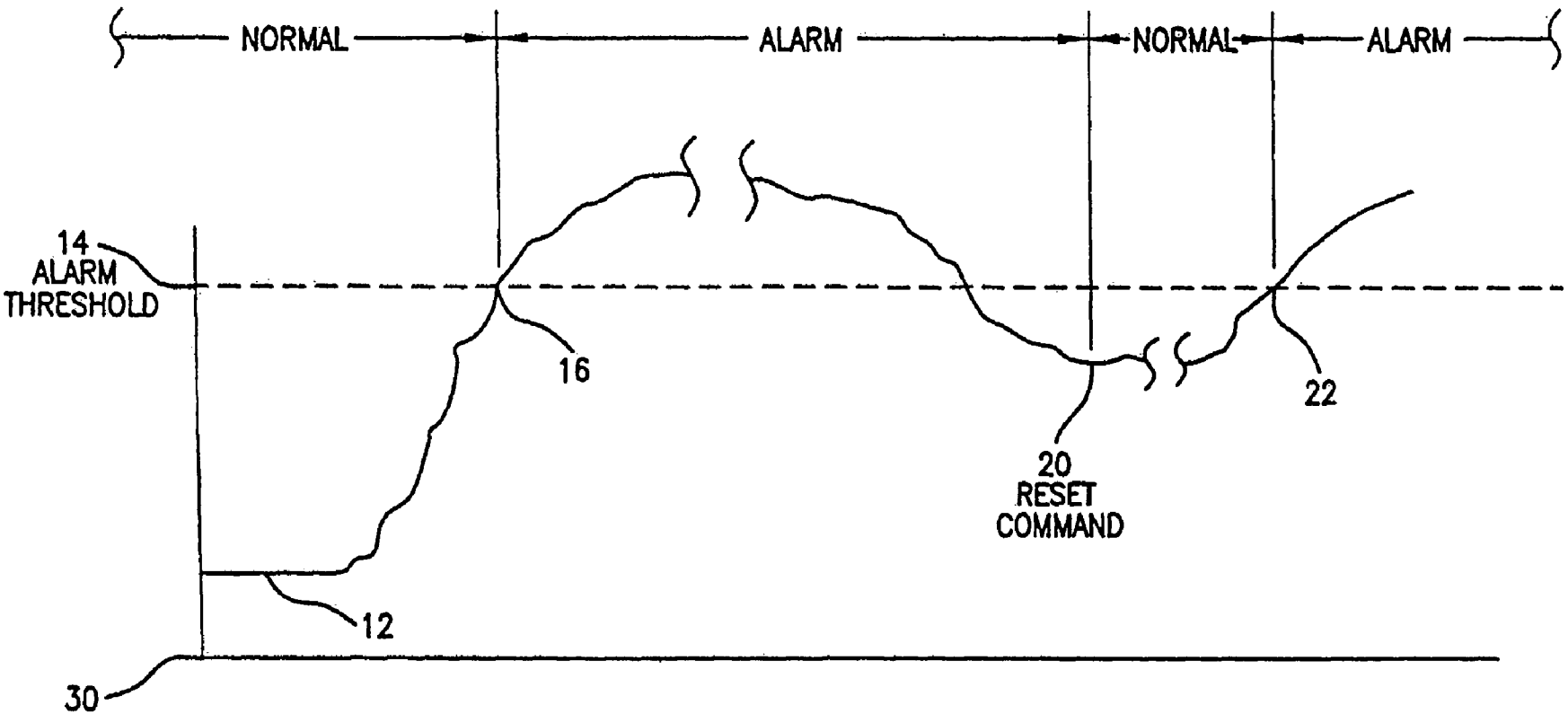
FIG. 3 (PRIOR ART)
FIG. 3 is a graph illustrating a problem presented by current art alarms.

FIG. 3 is a graph 30 illustrating a problem presented by current art alarms. In this example, a heat sensor with an alarm threshold 14 at 135° F. senses a temperature, e.g., 140° F., in excess of its alarm threshold 14. The building is evacuated and emergency personnel respond. They find a heat source, extinguish it, and believe the danger has been eliminated. In this scenario, however, they have found only part of the problem. An unseen fire still smolders behind a wall.

The sensor soon measures a lower temperature, say 130° F. Even though 130° F. is far from a normal temperature, currently existing sensors normally allow an unconditional successful system reset 20. Emergency personnel are falsely reassured that the danger is gone. They leave, and later the fire reinitiates. The temperature rises and triggers the alarm at 22, but by that time, emergency personnel have left.

An embodiment of the present invention may prevent this or similar scenarios by implementing an alarm reset threshold. In the above example, an alarm reset threshold set to some value below 130° F. (as according to an embodiment of the present invention) would have inhibited the system from being reset.

An embodiment of the present invention thus can indicate that current temperature or smoke is still above normal levels, even though the absolute reading is below the alarm threshold. System resets are inhibited, and the alarm remains latched until the temperature or smoke sensor reports a reading significantly below the alarm threshold. That is, the system has a different setting for restore/reset than for alarm.

Figure 1:
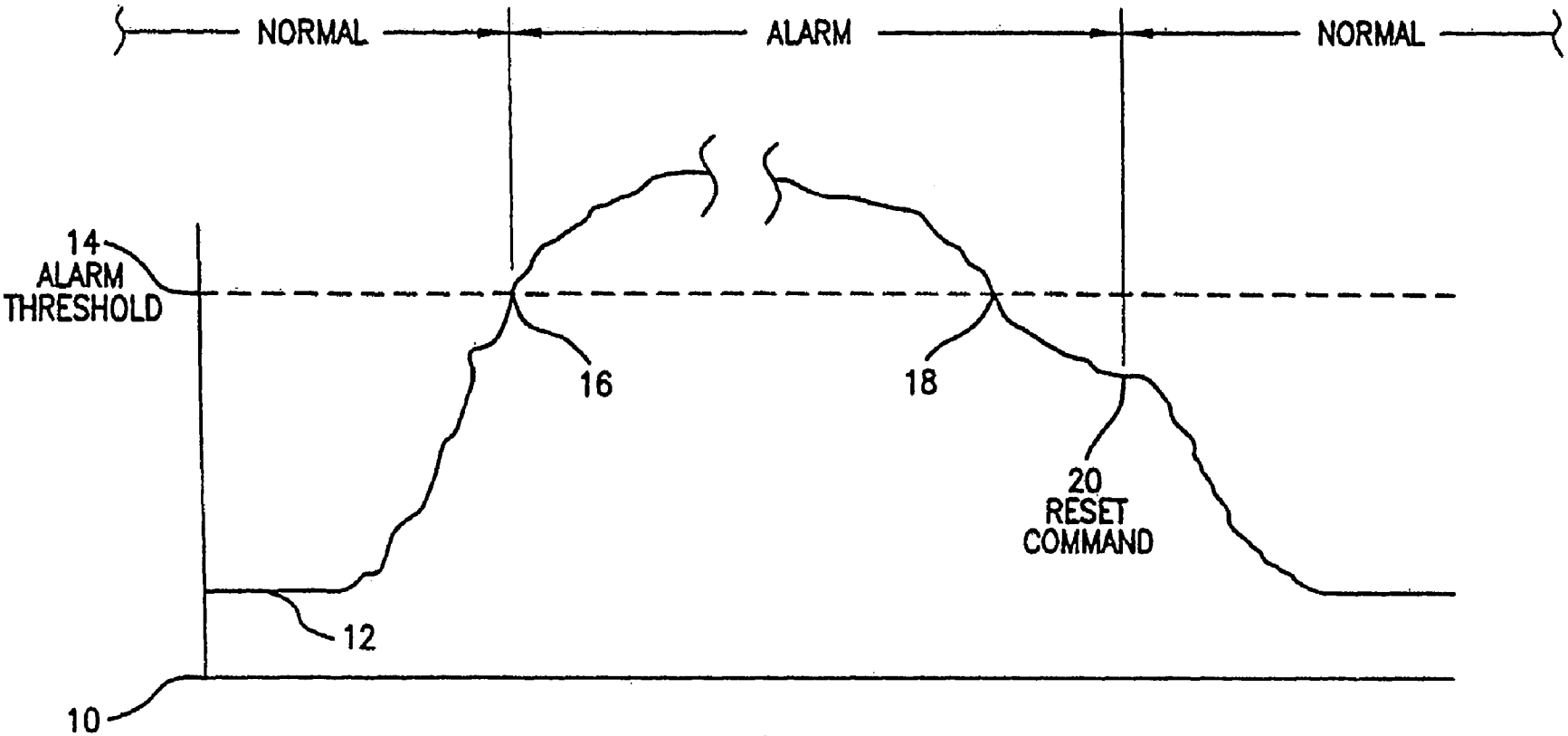
FIG. 1 (PRIOR ART)
FIG. 1 is a graph illustrating the voltage output of an operating conventional fire and smoke alarm and the alarm threshold.
Figure 4A:
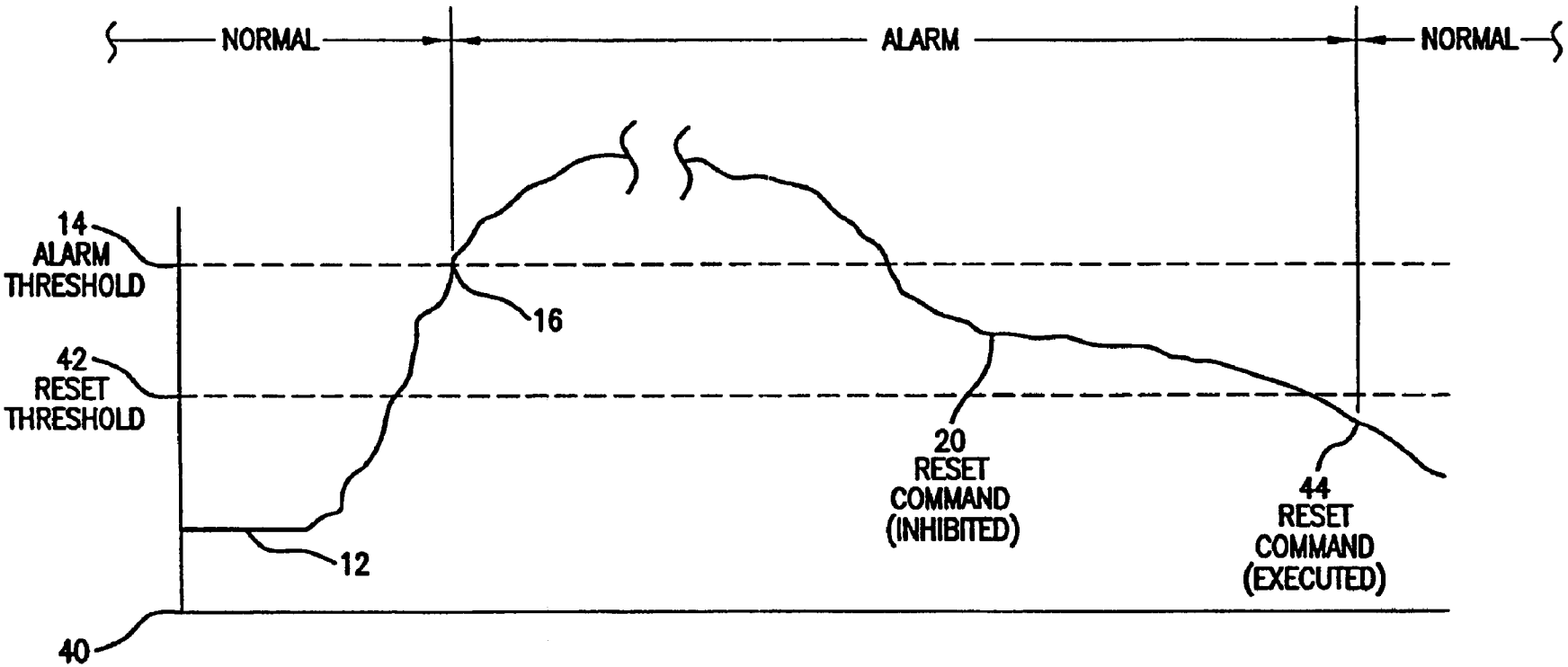
FIG. 4A is a graph illustrating the reset threshold aspect of an embodiment of the present invention.

FIG. 4A is a graph 40 illustrating the reset threshold aspect of an embodiment of the present invention. As in FIGS. 1 and 3, the measured parameter 12 (e.g., the detector output voltage) rises until, at 16, it crosses the alarm threshold 14, causing an alarm state. At 20, the visible fire has been put out, the temperature (or whatever parameter is being measured) has been reduced significantly, and the Emergency Responder presses the reset button or otherwise attempts to initiate an alarm reset.

Now, however, the measured parameter value 12 is still above the reset threshold 42. The request/command to reset the system is thus inhibited. A message such as "Warning—System Reset Aborted. Heat Sensor Reports Temperature is 125° F.," may be displayed or announced. A similar message for a smoke detector alarm might be "Warning—System Reset Aborted. Smoke Sensor Reports x % Smoke Still Present."

Later, at 44, the Emergency Responder again presses the reset button. This time, the measured parameter value 12 is below the reset threshold 42, and the system is reset, reverting to a normal state.

Figure 4B:
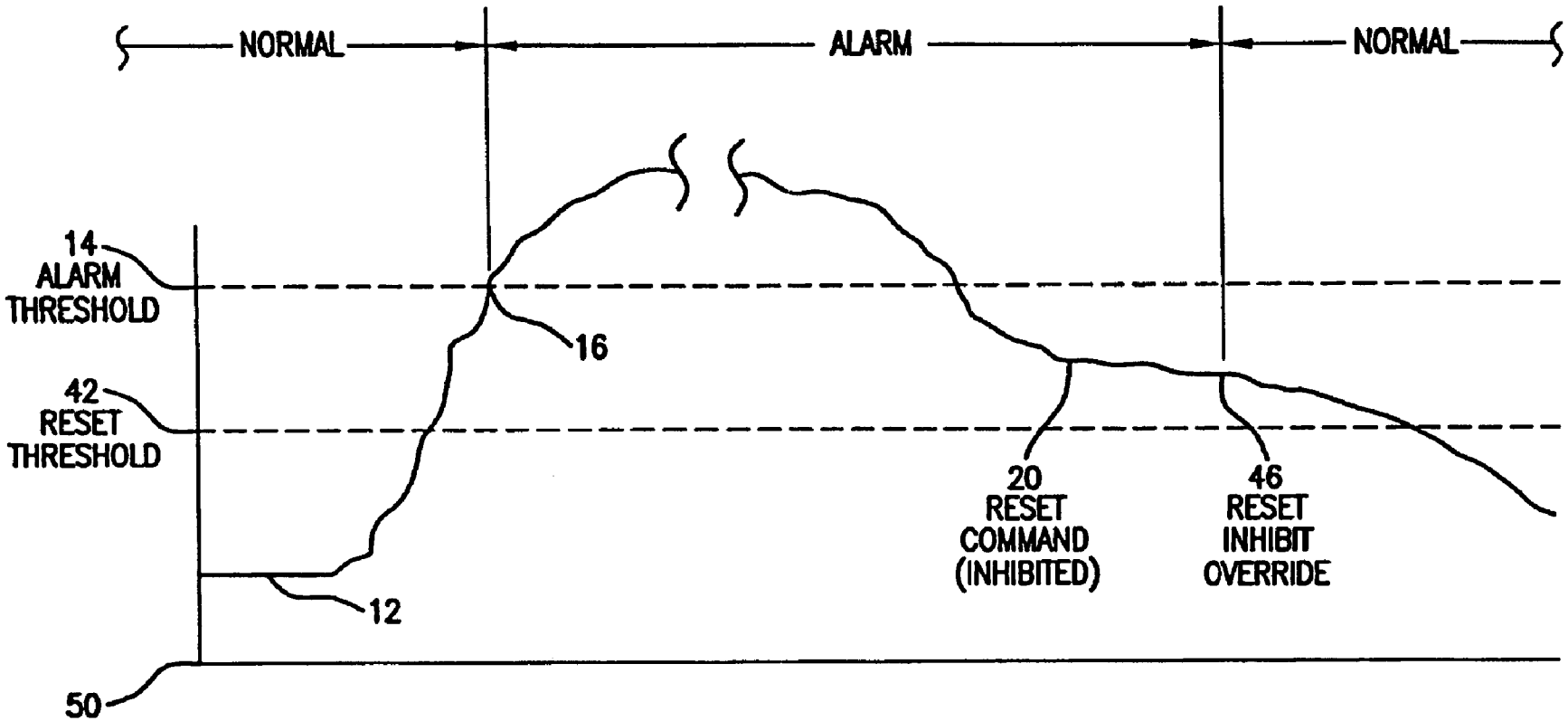
FIG. 4B is a graph illustrating a scenario similar to that of FIG. 4A, wherein in addition, an Emergency Responder attempts to override the reset inhibition.

FIG. 4B is a graph 50 illustrating a scenario similar to that of FIG. 4A, except that at 46, the Emergency Responder attempts to override the reset inhibition by, for example, pressing the reset button again, after a warning has been displayed or announced as discussed above, or by way of another example, by pressing a dedicated override button, or via some other means as would be readily understood by one skilled in the art. Here, the measured parameter value 12 is still above the reset threshold 42 but below the alarm threshold 14. The override is accepted, and the system is reset, reverting to a normal state.

Figure 5:
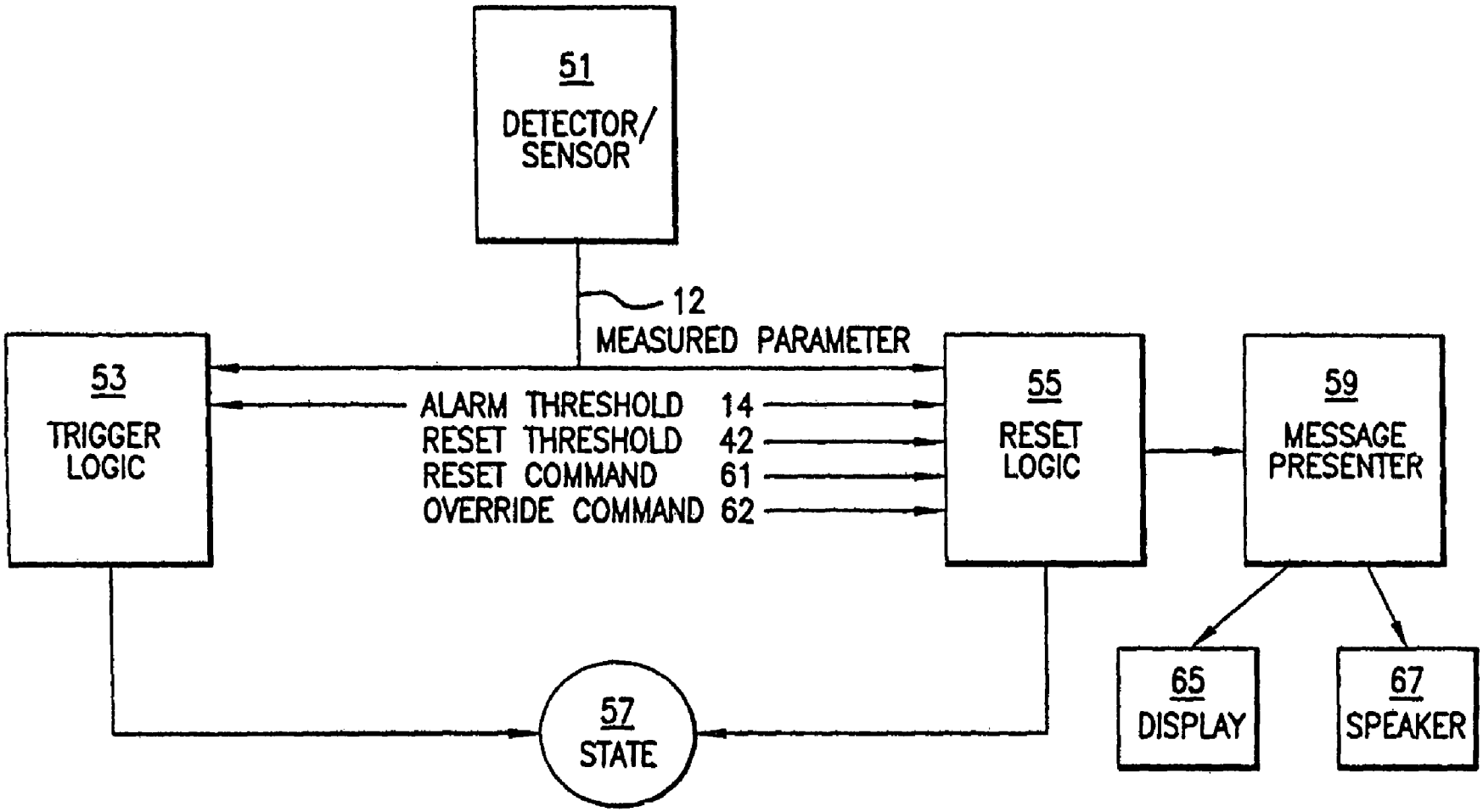
FIG. 5 is a block diagram of an implementation of an embodiment of the present invention.

FIG. 5 is a block diagram of an implementation of an embodiment of the present invention. A detector/sensor 51 senses the measured parameter and provides the value 12 to the trigger logic 53 and the reset logic 55, each of which can alter the state 57 of the system or unit.

The trigger logic 53 examines the measured parameter value 12 and the alarm threshold 14 to determine whether to assert an alarm state. Once an alarm state is asserted, it is latched; that is, the system does not revert back to a normal state without a reset command.

The reset logic 55, upon a reset command 61 or an override command 62, compares the measured parameter value 12 with the reset threshold 42 (and in the case of the override command, with the alarm threshold 14 as well) to determine whether to reset the system to a normal state, or to inhibit the request. On inhibiting a reset command 61 or an override command 62, a message enunciator or presenter 59 may display a warning message on a display device 65 or, alternatively, announce a pre-recorded or synthesized voice message on a speaker 67.

Note that although the various components of FIG. 5 are shown as discrete components, many of the functions may in fact be performed within a single component. Furthermore, each function may be implemented in software, hardware, or a combination, and may further be implemented using digital or analog technologies, or a combination therein. That is, the term "logic" includes, but is not limited to, digital hardware (circuitry) and/or software, as well as analog circuitry.

Figure 6:
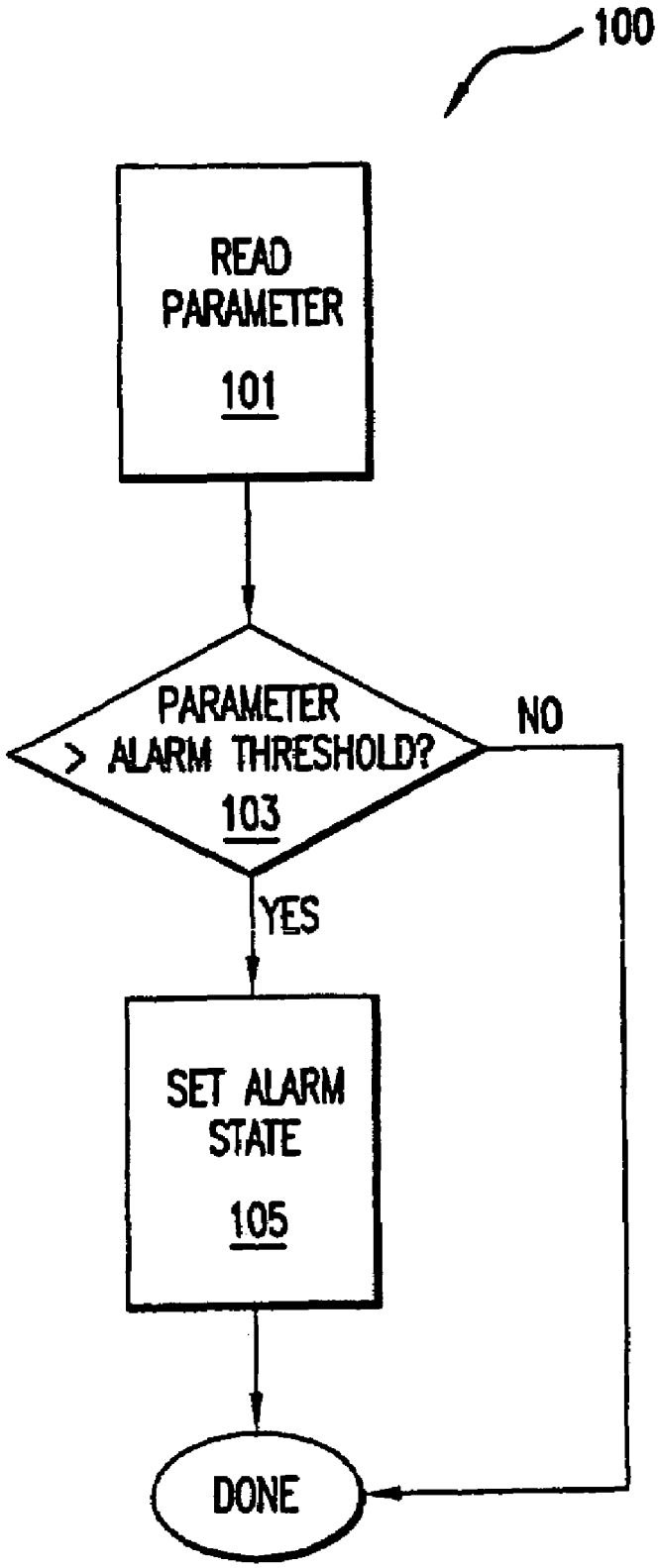
FIG. 6 is a flowchart illustrating operation of the trigger logic of FIG. 5.

FIG. 6 is a flowchart 100 illustrating operation of the trigger logic 53 of FIG. 5. At step 101, the detector 51 (FIG. 5) senses the measured parameter and provides a value 12. At step 103, the trigger logic 53 compares the measured value 12 with the alarm threshold 14. If the measured parameter value 12 is greater than the alarm threshold 14, then the alarm state is asserted and latched (step 105).

Figure 7:
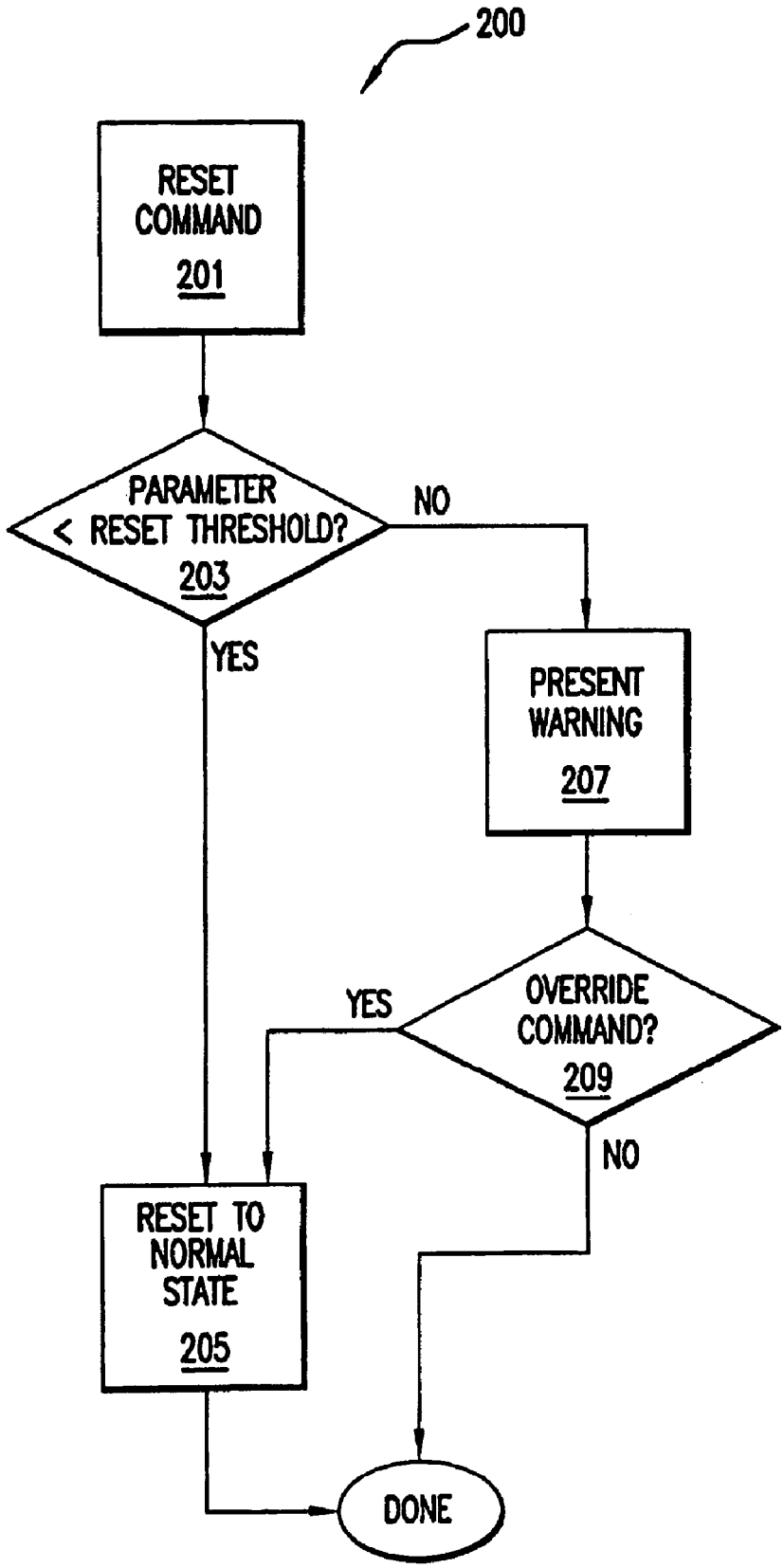
FIG. 7 is a flowchart illustrating operation of the reset logic and message presenter of FIG. 5.

FIG. 7 is a flowchart 200 illustrating operation of the reset logic 55 and message enunciator 59 of FIG. 5. At step 201, a reset command is initiated. At step 203, the measured parameter value 12 (FIG. 5) is compared with the reset threshold 42. If the measured parameter value 12 is less than the reset threshold 42 then the system is reset, reverting to a normal state (step 205).

If, on the other hand, the measured parameter value 12 is greater than the reset threshold 42, the system is not reset, i.e., reset is inhibited, and a warning message is displayed or announced (step 207). If an override command is then initiated (step 209), then the override command is implemented and, at step 205, the system is reset, reverting to a normal state.

While this invention has been particularly shown and described with references to preferred embodiments thereof, it will be understood by those skilled in the art that various changes in form and details may be made therein without departing from the scope of the invention encompassed by the appended claims.

For example, in the examples presented above, an alarm state is asserted when the measured parameter value is greater than the alarm threshold. One skilled in the art would recognize that, equivalently, for certain kinds of parameters and measurements, an alarm state might be asserted when the measured parameter value is below the alarm threshold. In this case, of course, the reset threshold would be higher than the alarm threshold.

In addition, it should be understood that it some embodiments, an alarm is asserted or a reset enacted or inhibited when the measured value exceeds the respective threshold. In other embodiments, the alarm is asserted or a reset enacted or inhibited when the value reaches, i.e., equals, the respective threshold. The language of the claims herein is meant to cover both cases.

What is claimed is:

1. A hazard alarm for detecting a hazardous condition for an area, comprising:

a detector which measures a hazard parameter;

trigger logic which triggers an alarm state when the measured parameter reaches a predetermined alarm threshold, the alarm state being maintained until a reset is successfully performed, the predetermined alarm threshold indicative of a hazardous condition in the area and used for triggering the alarm state from a non-alarm state; and reset logic which, upon a reset command, resets the alarm state to the non-alarm state if the measured parameter does not exceed a predetermined reset threshold, and which inhibits resetting of the alarm state to the non-alarm state if the measured parameter exceeds the predetermined reset threshold, the predetermined reset threshold being sufficiently different from the predetermined alarm threshold so as to be indicative of a continuing hazardous condition in the area, the hazardous condition indicative of a hazard in a first part of the area and the continuing hazardous condition indicative of the hazard in a second part of the area, the alarm threshold and reset threshold being sufficiently different to prevent reset of the alarm state when the hazard continues to pertain in the second part even after the hazard in the first part ceases.

2. The hazard alarm of claim 1, the hazard parameter comprising an indication of at least one of: heat, fire, smoke, carbon monoxide and natural gas.

3. The hazard alarm of claim 1, inability to reset being an indication that a smoldering fire may still exist.

4. The hazard alarm of claim 1, inability to reset being an indication that an unseen heat source is present.

5. The hazard alarm of claim 1, further comprising:

a message presenter which, upon the reset command, presents a warning message if the measured parameter exceeds the reset threshold.

6. The hazard alarm of claim 5, the message presenter being a display device which displays the warning message.

7. The hazard alarm of claim 1, the reset threshold being set to a factory default.

8. The hazard alarm of claim 1, the reset threshold being set to a level approved by a local authority.

9. The hazard alarm of claim 1, where the reset threshold is constant.

10. The hazard alarm of claim 1, where the reset threshold is variable.

11. The hazard alarm of claim 1, further comprising:

reset override logic which, when activated, overrides the reset circuitry by resetting the alarm state even if the measured parameter exceeds the reset threshold.

12. The hazard alarm of claim 11, the reset threshold tracking the alarm's average analog value.

13. The hazard alarm of claim 1, the reset threshold tracking the alarm's average analog value.

14. The hazard alarm of claim 11, where the reset threshold varies dependent on previous measurements of the hazard parameter.

15. The hazard alarm of claim 1, where the reset threshold varies dependent on previous measurements of the hazard parameter.

16. A hazard alarm for detecting a hazardous condition for an area, comprising:

a detector which measures a hazard parameter;

trigger logic which triggers an alarm state when the measured parameter reaches a predetermined alarm threshold, the alarm state being maintained until a reset is successfully performed, the predetermined alarm threshold indicative of a hazardous condition in the area and used for triggering the alarm state from a non-alarm state;

reset logic which, upon a reset command, resets the alarm state to the non-alarm state if the measured parameter does not exceed a predetermined reset threshold, and which inhibits resetting of the alarm state to the non-alarm state if the measured parameter exceeds the predetermined reset threshold, the predetermined reset threshold being sufficiently different from the predetermined alarm threshold so as to be indicative of a continuing hazardous condition in the area; and reset override logic which, when activated, overrides the reset circuitry by resetting the alarm state even if the measured parameter exceeds the reset threshold.

17. The hazard alarm of claim 16, the reset threshold tracking the alarm's average analog value.

18. The hazard alarm of claim 16, where the reset threshold varies dependent on previous measurements of the hazard parameter.

19. A hazard alarm for detecting a hazardous condition for an area, comprising:

a detector which measures a hazard parameter;

trigger logic which triggers an alarm state when the measured parameter reaches a predetermined alarm threshold, the alarm state being maintained until a reset is successfully performed, the predetermined alarm threshold indicative of a hazardous condition in the area and used for triggering the alarm state from a non-alarm state;

reset logic which, upon a reset command, resets the alarm state to the non-alarm state if the measured parameter does not exceed a predetermined reset threshold, and which inhibits resetting of the alarm state to the non-alarm state if the measured parameter exceeds the predetermined reset threshold, the predetermined reset threshold tracking the alarm's average analog value and being sufficiently different from the predetermined alarm threshold so as to be indicative of a continuing hazardous condition in the area.

20. A method for implementing a hazard alarm, comprising:

asserting an alarm state if a measured hazard parameter exceeds an alarm threshold, the alarm threshold indicative of a hazardous condition in the area and used for triggering the alarm state from a non-alarm state; and upon a reset command, resetting the alarm state if the measured parameter does not exceed a reset threshold, the reset threshold being sufficiently different from the alarm threshold so as to be indicative of a continuing hazardous condition in the area, inhibiting resetting of the alarm state if the measured parameter exceeds the predetermined reset threshold, the hazardous condition indicative of a hazard in a first part of the area and the continuing hazardous condition indicative of the hazard in a second part of the area, the trigger threshold and reset threshold being sufficiently different to prevent reset of the alarm state when the hazard continues to pertain in the second part even after the hazard in the first part ceases.

21. The method of claim 20, the hazard parameter comprising an indication of at least one of: heat, fire, smoke, carbon monoxide and natural gas.

22. The method of claim 20, inability to reset being an indication that a smoldering fire may still exist.

23. The method of claim 20, inability to reset being an indication that an unseen heat source is present.

24. The method of claim 20, further comprising:

upon the reset command, presenting a warning message if the measured parameter exceeds the reset threshold.

25. The method of claim 24, a warning message being presented by displaying the message.

26. The method of claim 20, the reset threshold being set to a factory default.

27. The method of claim 20, the reset threshold being set to a level approved by a local authority.

28. A method for implementing a hazard alarm, comprising:

asserting an alarm state if a measured hazard parameter exceeds an alarm threshold, the alarm threshold indicative of a hazardous condition in the area and used for triggering the alarm state from a non-alarm state; and upon a reset command, resetting the alarm state if the measured parameter does not exceed a reset threshold, the reset threshold being sufficiently different from the alarm threshold so as to be indicative of a continuing hazardous condition in the area, and inhibiting resetting of the alarm state if the measured parameter exceeds the predetermined reset threshold; and upon a reset inhibition override command, resetting the alarm state even if the measured parameter exceeds the reset threshold.

29. A method for implementing a hazard alarm, comprising:

asserting an alarm state if a measured hazard parameter exceeds an alarm threshold, the alarm threshold indicative of a hazardous condition in the area and used for triggering the alarm state from a non-alarm state; and upon a reset command, resetting the alarm state if the measured parameter does not exceed a reset threshold, the reset threshold tracking the alarm's average analog value and being sufficiently different from the alarm threshold so as to be indicative of a continuing hazardous condition in the area, and inhibiting resetting of the alarm state if the measured parameter exceeds the predetermined reset threshold.

30. A hazard alarm, comprising:

means for asserting an alarm state if a measured hazard parameter exceeds an alarm threshold, the alarm threshold indicative of a hazardous condition in the area and used for triggering the alarm state from a non-alarm state; and means for, upon a reset command, resetting the alarm state if the measured parameter does not exceed a reset threshold, the reset threshold being sufficiently different from the alarm threshold so as to be indicative of a continuing hazardous condition in the area, and inhibiting resetting of the alarm state if the measured parameter exceeds the predetermined reset threshold; and means for resetting, upon a reset inhibition override command, the alarm state even if the measured parameter exceeds the reset threshold.

31. The hazard alarm of claim 30, further comprising:

means for presenting, upon the reset command, a warning message if the measured parameter exceeds the reset threshold.

32. A hazard alarm for detecting a hazardous condition for an area, comprising:

a detector which measures a hazard parameter;

trigger logic which triggers an alarm state when the measured parameter reaches a predetermined alarm threshold, the alarm state being maintained until a reset is successfully performed, the predetermined alarm threshold indicative of a hazardous condition in the area and used for triggering the alarm state from a non-alarm state;

reset logic which, upon a reset command, resets the alarm state to the non-alarm state if the measured parameter does not exceed a predetermined reset threshold, and which inhibits resetting of the alarm state to the non-alarm state if the measured parameter exceeds the predetermined reset threshold, the predetermined reset threshold varying dependent on previous measurements of the hazard parameter and being sufficiently different from the predetermined alarm threshold so as to be indicative of a continuing hazardous condition in the area.

* * * * *